US005518155A

United States Patent [19]

Gallagher

[11] Patent Number: 5,518,155

[45] Date of Patent: May 21, 1996

[54] HOLSTER LOCK

[76] Inventor: Richard N. Gallagher, 2019 W. Quail Ave., Phoenix, Ariz. 85027

[21] Appl. No.: 320,268

[22] Filed: Oct. 11, 1994

[51] Int. Cl.[6] ..... F41C 33/04

[52] U.S. Cl. ..... 224/244; 224/242; 224/911

[58] Field of Search ..... 224/242, 243, 224/244, 245, 246, 911

[56] References Cited

U.S. PATENT DOCUMENTS

| | | | |
|---|---|---|---|
| 1,046,912 | 12/1912 | Wanee | 224/243 |
| 1,635,984 | 7/1927 | Corriston | 224/911 |
| 1,641,439 | 9/1927 | Jovino | 224/244 |
| 2,349,376 | 5/1944 | Ray | 224/244 |
| 2,551,913 | 5/1951 | Toby | 224/911 |
| 2,577,869 | 12/1951 | Adams | 224/911 |
| 3,669,325 | 6/1972 | Furman | 224/243 |
| 5,275,317 | 1/1994 | Rogers et al. | 224/911 |
| 5,284,281 | 2/1994 | Nichols | 224/911 |
| 5,395,021 | 3/1995 | Brown | 224/912 |

*Primary Examiner*—Henry J. Recla
*Assistant Examiner*—Charles R. Eloshway
*Attorney, Agent, or Firm*—Tod R. Nissle

[57] ABSTRACT

A handgun holster includes a system for simultaneously contacting the trigger guard and muzzle of a handgun in the holster to prevent the handgun from being removed until desired by the wearer.

1 Claim, 4 Drawing Sheets

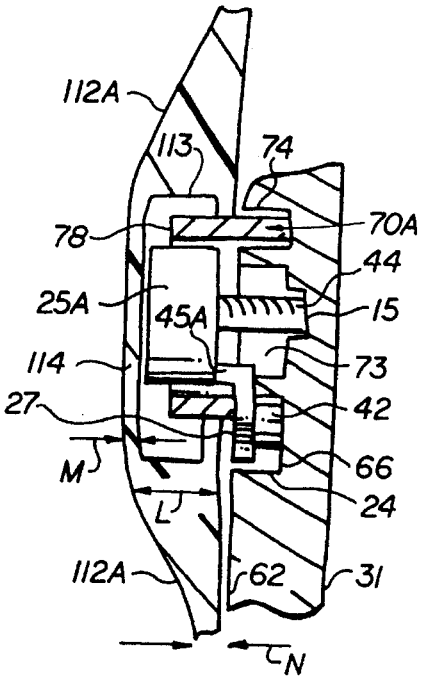
FIG. 9
FIG. 10
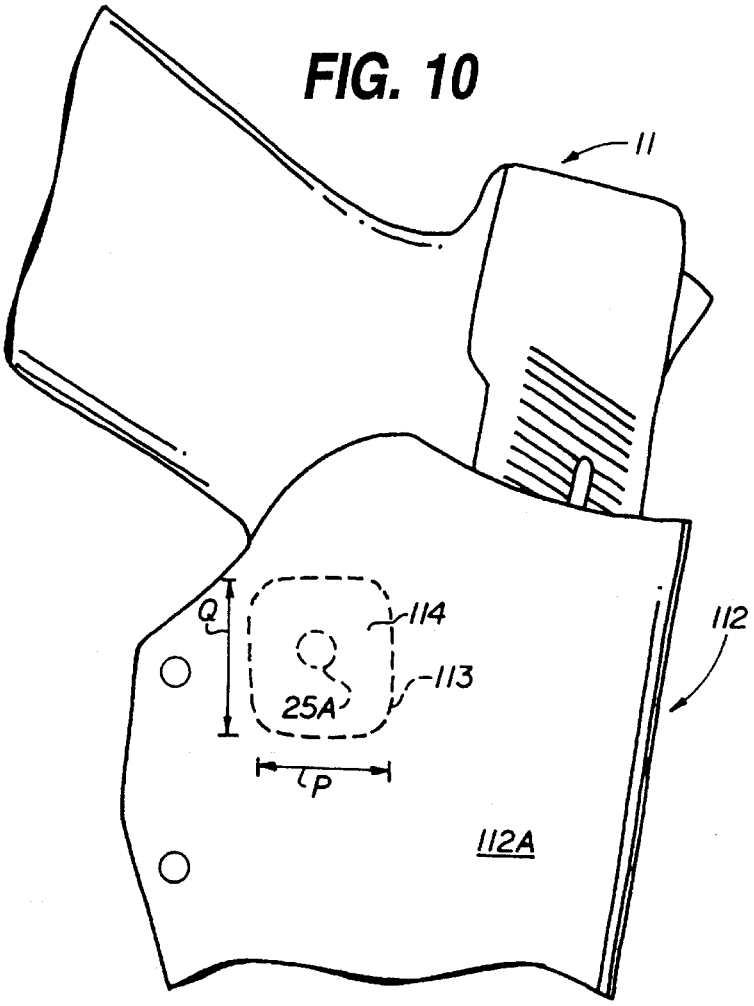

HOLSTER LOCK

This invention relates to a handgun holster.

More particularly, the invention relates to a handgun holster including a system for contacting the trigger guard and muzzle of a handgun in the holster to prevent the handgun from being removed until desired by the wearer.

In another respect, the invention pertains to a handgun holster of the type described which automatically engages both the trigger guard and the muzzle of a handgun when inserted in the holster to lock the handgun in selected position in the holster.

While undertaking his duties, a law enforcement officer on occasion becomes involved in hand to hand combat with a fugitive who attempts to withdrawal the officer's handgun from its holster. Each year, there are, unfortunately, instances in the United States where such a circumstance occurs and the fugitive is successful in removing the handgun from its holster and then using the handgun on the officer.

Accordingly, it would highly desirable to provide a handgun holster which would automatically lock in place a handgun inserted in the holster, which would make it difficult for any party other than the law enforcement officer to remove the handgun from it's holster, and, which would enable the law enforcement officer wearing the handgun to readily remove the handgun from its holster when desired.

Therefore, it is a principal object of the invention to provide an improved handgun holster.

A further object of the invention is provide an improved handgun holster which automatically engages and locks in place a handgun inserted in the holster.

Another object of the invention is to provide a handgun holster with a locking system which is difficult for another party to operate in order to extract a handgun from the holster against the wishes of a law enforcement officer wearing the holster.

These and other, further and specific objects of the invention will be apparent to those skilled in the art from the following detailed description thereof, including the drawings, in which:

FIG. 9 is a front section view illustrating an alternate embodiment of the invention in which the finger rest of the locking member is concealed; and, FIG. 10 is a side elevation view illustrating a holster equipped with the trigger guard restraining device of FIG. 9.

Figure 1:
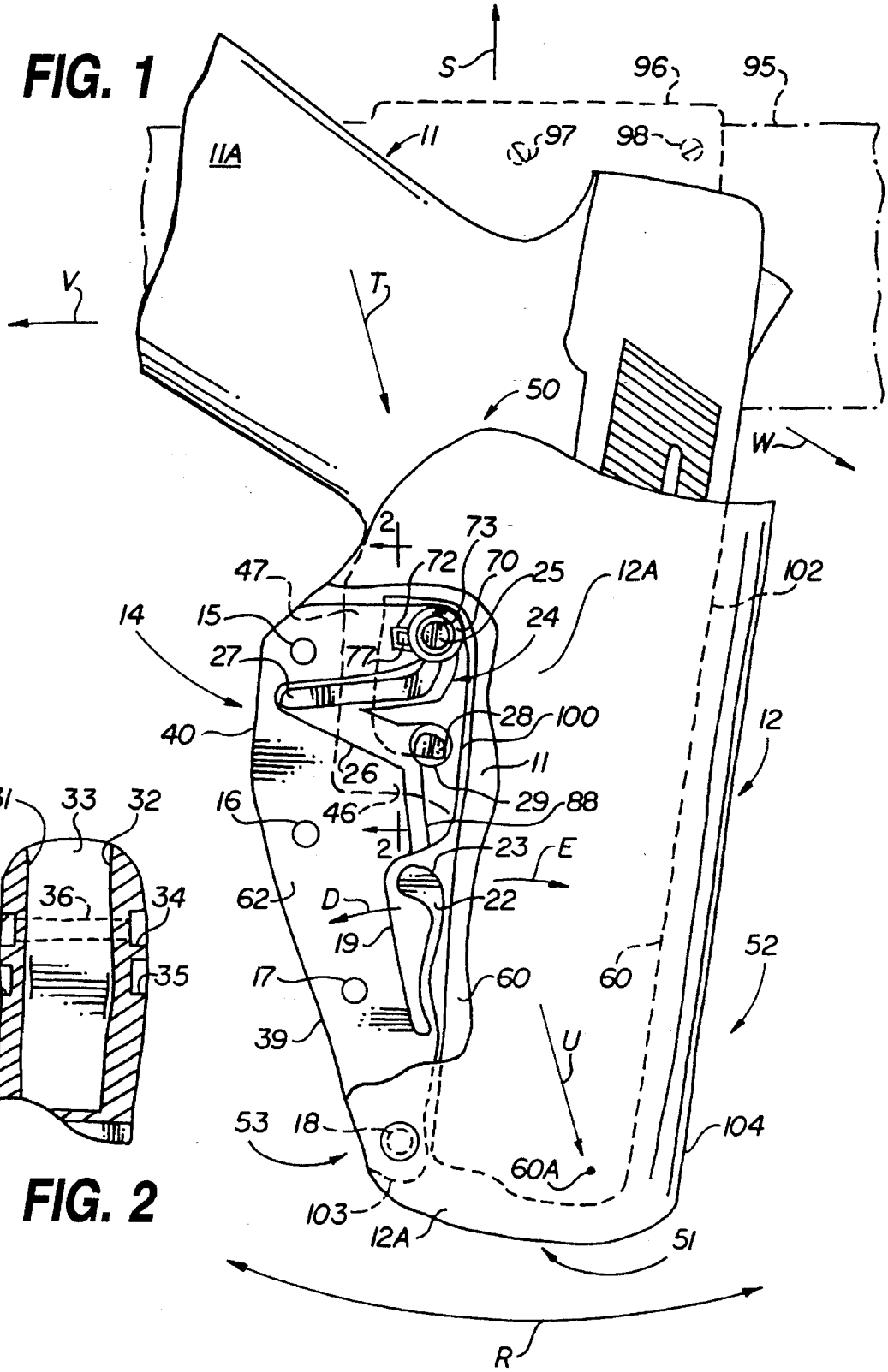
FIG. 1 is a side elevation view illustrating a holster constructed in accordance with the principles of the invention and having an automatic handgun therein.
Figure 2:
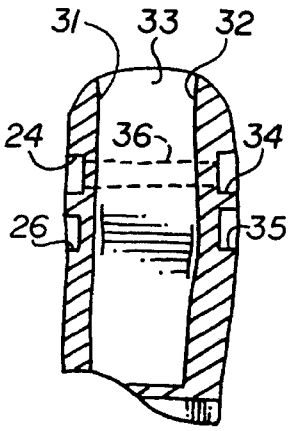
FIG. 2 is a section view of a portion of the trigger guard restraining device of the holster of FIG. 1 illustrating further internal constructing details thereof and taken along section line 2—2.

Briefly, in accordance with my invention, I provide in combination with a handgun holster a lockable and releasable trigger guard restraining device adapted to selectively prevent withdrawal of a handgun having a trigger guard from the holster. The holster has with respect to a wearer an inner wall, and outer wall, a front, a back, a top, a bottom, and inside, an outside, and a means for suspending said holster from a belt worn by a wearer. The trigger guard restraining device is attached to the inside of the holster at the back of the holster. The restraining device includes a rigid body portion and two upwardly extending vertical side wall members adjacent opposite sides respectively of the body portion forming a channel adapted to receive therein a trigger guard of a handgun; a channel formed through the rigid body portion and extending from one of the side wall members to the other of the side wall members; and, a locking member. The locking member includes a first arm extending along one of the sides; a second arm extending along the other of the sides; a lock element attached to the second arm; and, a rod slidably extending through said channel and interconnecting said first and second arms. The rod interconnects the first and second arms such that the rod and the arms can be manually laterally displaced between two operative positions, a first operative position with the lock element positioned to prevent withdrawal from the holster of a handgun having a trigger guard, and a second operative position with the lock element laterally displaced from the first operative position to permit the withdrawal from the holster of a handgun having a trigger guard.

In another embodiment of the invention, I provide in combination with a handgun holster a lockable and releasable trigger guard restraining device adapted to selectively prevent withdrawal of a handgun having a trigger guard from the holster. The handgun includes with respect to a wearer an inner wall, an outer wall, a front, a back, a top, a bottom, an inside, an outside, and a means for suspending the holster from a belt worn by a wearer. The restraining device is attached to the inside of the holster at the back. The restraining device includes a rigid body portion and two upwardly extending vertical side wall members adjacent opposite sides respectively of the body portion forming a channel adapted to receive therein a trigger guard of a handgun. The body portion also includes a locking member and a resilient spring arm attached to the rigid body portion to be displaced by and bear against the muzzle of a handgun when the handgun is inserted in the holster. The locking member is moveable between two operative positions, a first operative position to prevent withdrawal from the holster of a handgun having a trigger guard, and a second operative position to permit the withdrawal from the holster of a handgun having a trigger guard.

Turning now to the drawings, which depict the presently preferred embodiment of the invention for purposes of illustrating the practice thereof and not by way of limitation of the scope of the invention, and in which like reference characters refer to corresponding elements throughout the several views, FIGS. 1–6 illustrate a holster 12 and a trigger guard restraining device 14 mounted inside holster 12 intermediate the side walls 12A and 12B of the holster 12. With respect to a right-handed user wearing holster 12, wall 12B is the inner side wall and wall 12B is the outer side wall. Holster 12 includes top 50, bottom 51, front 52, and back 53.

Figure 3:
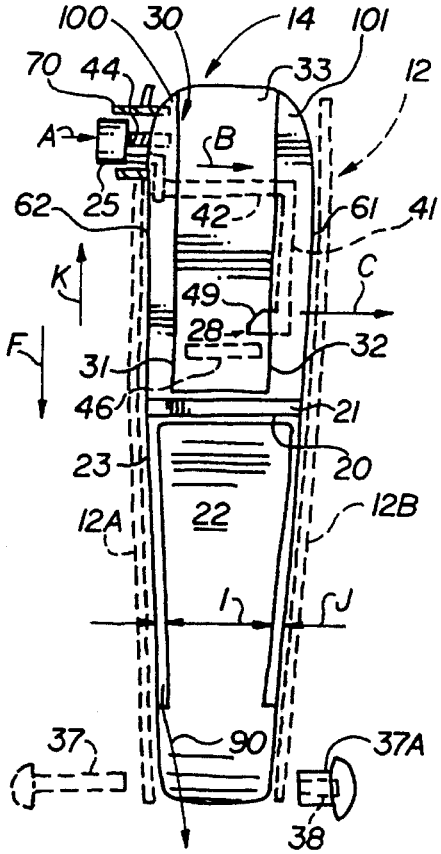
FIG. 3 is a front elevation view of the trigger guard restraining device of the holster of FIG. 1 illustrating further construction details thereof.

Holster 12 is presently formed in conventional fashion by wrapping a single piece of leather, plastic, or other material around a mold into the configuration shown in FIG. 1. If desired, plastic can be pre-heated prior to being wrapped around a mold and can then, after being wrapped, be permitted to cool. Trigger guard restraining device 14 is mounted inside holster 12 intermediate side walls 12A and 12B with four externally threaded fasteners 37. As illustrated in FIG. 3 each fastener 37 passes through side wall 12A, through one of apertures 15–18, through side wall 12B, and is turned into internally threaded aperture 38 of nut 37A.

The trigger guard restraining device 14 includes elongate resilient finger member 22 which is laterally displaced in the direction of arrow D (FIG. 1) when the muzzle 60 of a handgun 11 is inserted in holster 12. Device 14 also includes upwardly depending spaced apart side walls 61 and 62. Side walls 61 and 62 bound and define and bound a channel to receive the trigger guard 46, 47 of handgun 11 when holstered. The channel includes opposed, spaced apart side surfaces, 31, 32, and includes back surface 33. Surfaces 39 and 40 comprise the rear spine of device 14. The upper rounded surface 23 of finger 22 (FIGS. 3 and 4) is positioned beneath surface 21 of device 14 both before and after a handgun is inserted in the holster 12. The upper end of finger 22 is also presently preferably, but not necessarily, spaced apart from side wall 19 both before and after a handgun 11 is inserted in holster 12. Inserting a handgun 11 in holster 12 causes muzzle 60 to contact and slide downwardly over rounded surface 23 and resiliently displace in the direction of arrow D finger 22 from the position shown in FIGS. 3 and 4 to the position shown in FIG. 1. When finger 22 is in the position shown in FIG. 1, it resiliently attempts to return to the position shown in FIGS. 3 and 4 and, consequently, bears against muzzle 60 and generates a force in the direction of arrow E. Finger 22 therefore fictionally engages muzzle 60 and presses muzzle 60 against the front 52 of holster 12 to generates forces which tend to lock muzzle 60 in position in holster 12 and prevent handgun 11 from being removed from holster 12.

U-shaped grooves 34, 35 and 89 are formed in the surface of side wall 61. U-shaped grooves 34 and 35 in combination generally define a V-shaped groove in the surface of side wall 61. U-shaped groove 89 permits moisture to travel from apertures 15A and 36 and from locking member 50 under gravity down through grooves, 34, 35 and 89 in the direction of arrow 91 and into the holster toward the bottom of the holster. The width, indicated by arrow I in FIG. 3, of the bottom of finger 22 is less than the inside width or distance, indicated by arrow J, between the sides 61 and 62 of device 14 and between the inner surfaces of the walls 12A and 12B of the holster 12. Consequently, water flowing from groove 89 inside the holster passes between finger 22 and the sides of the holster and out through the open bottom of the holster in the manner indication by arrow 90 in FIG. 3. This water drainage system is an important feature of the invention because it reduces the likelihood that corrosion will occur and that water will cause the walls of the holster to swell. Corrosion and swelling of the wall of the holster can cause locking member 50 to bind.

U-shaped grooves 24, 26, and 88 are formed in the surface of side wall 62. Groove 88 facilitates water drainage in the same manner discussed above for groove 89. U-shaped grooves 24 and 26 in combination generally define a V-shaped groove in surface of side wall 62. Cylindrical aperture or channel 36 is formed through device 14 intermediate surfaces 33 and 40. Surfaces 19 and 21 co-terminate along line 20. Channel 36 and grooves 24, 26, 34, 35 are further illustrated in FIG. 2.

Figure 7:
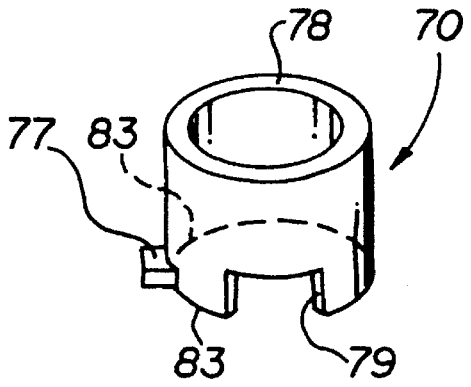
FIG. 7 is a perspective view illustrating the stove pipe used to house the finger rest of the locking member of FIG. 5.
Figure 8:
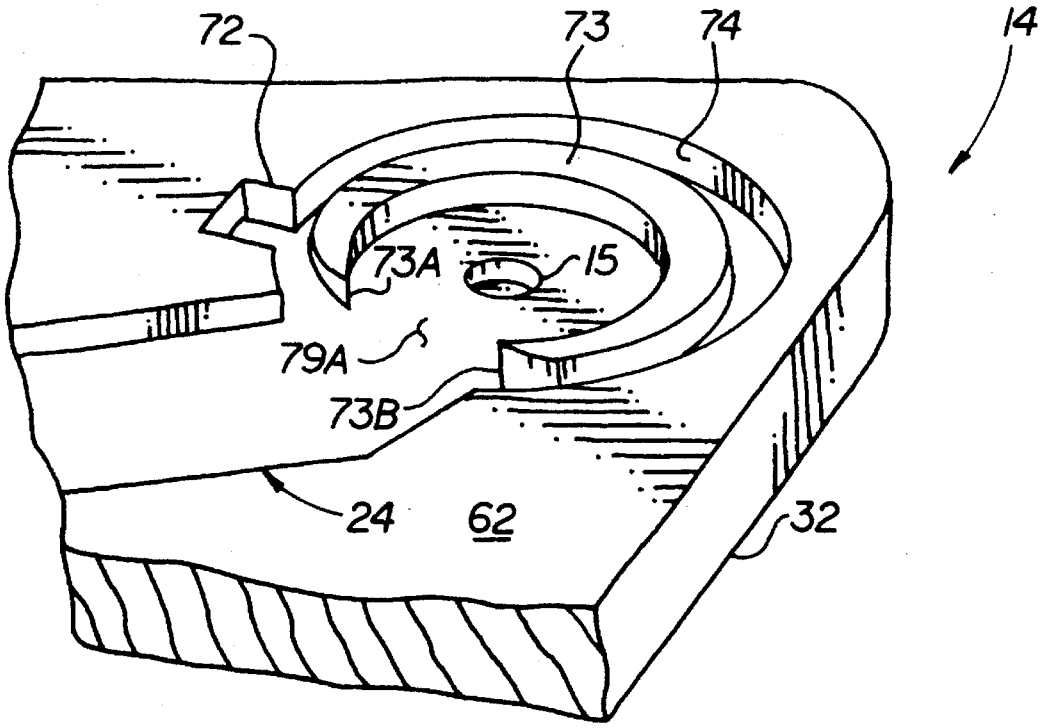
FIG. 8 is a perspective view of a corner of the trigger restraining device of FIGS. 3 and 4 illustrating grooves used to seat the stove pipe of FIG. 7.

The cylindrical hollow stove pipe 70 is shown standing alone in FIG. 7 and includes upper circular edge 78, lower circular edge 83, U-shaped opening 79, and foot 77. The lower edge 83 seats and is glued in the C-shaped groove 74 formed in the side 62 of device 14. When edge 83 is seated in groove 74, edge 83 contacts and circumscribes upraised C-shaped lip 73, opening 79 is aligned with opening 79A intermediates edges 73A and 73B, and foot 77 is in U-shaped opening 72.

The locking member 50 incorporated in device 14 includes arms 27 and 41; locking element 28; and, rod 42 interconnecting arms 27 and 41. Member 45 interconnects cylindrical finger rest 25 and the distal end of arm 27. Locking element 28 includes sloped surface 49. When locking member is installed in device 14 in the manner illustrated in FIGS. 1, 3, 4, 6A and 6B, rod 42 slidably extends through aperture 36. Arm 27 is seated in groove 24 and arm 41 is seated in groove 35. Locking element 49 extends through aperture 29. Spring 44 extends intermediate finger rest 25 and aperture 24 formed in the surface of side wall 62.

Figure 6A:
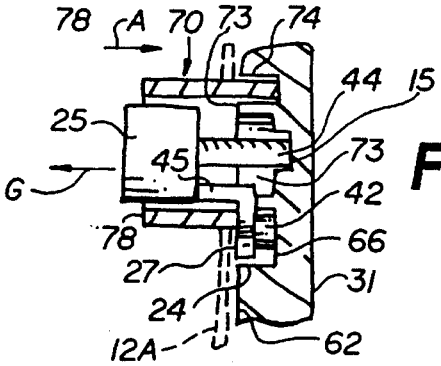
FIG. 6A is a sectional view of a portion of the holster of FIG. 1 illustrating the mode of operation of the trigger guard restraining device.

Locking member 50 has two operative positions in device 14. The first normal operative position is illustrated in FIGS. 3 and 6A. In the first normal operative position, spring 44 displaces finger rest 25 away from side wall 62 in the direction of arrow G to the position shown in FIGS. 3 and 6A. When finger rest 25 and locking member 50 are in the position shown in FIGS. 3 and 6A, arm 27 is spaced away (FIG. 6A) from the bottom 66 of groove 26, and arm 41 is seated in and contacting the bottom 67 of groove 35. Furthermore, when locking element 50 is in the position shown in FIGS. 3 and 6A, locking element 28 extends into the space between surfaces 31 and 32 such that the front member 46 (FIG. 3) of the trigger guard of handgun 11 cannot be moved in the direction of arrow E and handgun 11 is, therefore, locked in position in holster 12.

In order to remove handgun 11 from holster 12, the wearer grasps the handle 11A of handgun 11 with his right hand, extends his right forefinger over handle 11A and side 12A in the direction of and parallel to and over arrow T until the tip of the forefinger contacts finger rest 25. The User's right forefinger then generally points in the direction of arrow U toward the outer end 60A of muzzle 60. The afore-described positioning of the hand and right forefinger on handgun 11 simulates a combat grip. A combat grip is desirable because when a proper procedure is utilized to withdraw a gun from a holster, the user grasps the gun in a combat grip with his forefinger along the side of the gun and off of the trigger. The forefinger is not put on the trigger until the user is ready to fire the gun.

Figure 6B:
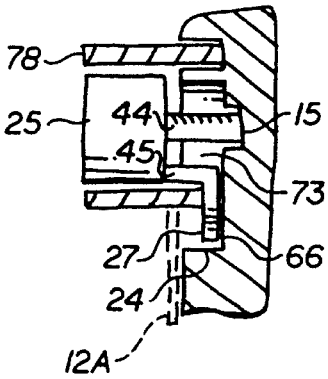
FIG. 6B is a partial sectional view of the portion of the trigger guard restraining device of FIG. 1 further illustrating the mode of operation thereof.

After the user grasps the handle of the handgun with a combat grip, the user utilizes his right forefinger to press and displace finger rest 25 in the direction of arrow E and compress spring 44 until finger rest 25 contacts the side 12A of holster 12 (FIG. 6B). Displacing finger rest 25 in the direction of arrow A and against side 12A moves locking element 28 through aperture 29 and out of the space intermediate surfaces 31 and 32 such that member 46 of the trigger guard can be freely outwardly moved in the direction of arrow K (FIG. 3) and handgun 11 can be removed from holster 12. As soon as the wearer's forefinger is removed from finger rest 25, and the pressure displacing finger rest 25 in the direction of arrow A is released, spring 44 expands and causes locking member 50 to return to the position shown in FIG. 3. When finger rest 25 is displaced in the direction of arrow A to the position illustrated in FIG. 6B, rod 42 slides a short distance along and through cylindrical aperture 36, arm 27 is pressed against the bottom 66 of groove 26, and arm 41 is displaced a short distance away from the bottom 67 of groove 35. Accordingly, rod 42 is sufficiently long to permit rod 42 and arms 27 and 41 to be laterally displaced a short distance back and forth in the directions of arrows A and G by pressing and releasing, respectively, finger rest 25.

When locking member 50 is in the position illustrated in FIGS. 3 and 6A, handgun 11 can be readily inserted in holster 12 without the wearer's using his forefinger to depress finger rest 25 in the direction of arrow A. This is the case because when muzzle 60 is slid into holster 12, member 46 of the trigger guard contacts sloped surface 49 of locking element 28 to generate a lateral displacement force in the direction of arrow C to cause arms 27 and 41, rod 42, and finger rest 25 to be displaced in the direction of arrow C. As soon as the handgun is moved far enough into to the holster to position member 46 beneath element 28 as shown in ghost outline in FIG. 3, spring 44 laterally displaces locking member 50 to the position illustrated in FIG. 3 such that locking element prevents member 46 from being moved upwardly in the direction of arrow E and out of the holster.

The locking member 50 is constructed and incorporated in device 14 for use by a right handed person. Device 14 is adapted for a left handed person by removing member 50 and installing an auxiliary locking member in device 14. The auxiliary locking member is installed by placing in groove 34 a first auxiliary arm identical in shape and dimension to arm 27; by placing in groove 26 a second auxiliary arm identical in shape and dimension to arm 41; by attaching an auxiliary locking element to the end of the second auxiliary arm positioned over aperture 29 such that the auxiliary locking element extends through aperture 29 inwardly toward surface 31; by interconnecting the first and second auxiliary arms with an auxiliary rod which extends through aperture 36 and is attached to the first and second auxiliary arms; by attaching an auxiliary finger rest equivalent in shape and dimension to finger rest 25 to the end of the first auxiliary arm near aperture 15A; and, by placing in aperture 15A an auxiliary spring equivalent in shape and dimension to spring 44, said auxiliary spring extending from aperture 15A to the auxiliary finger rest. Aperture has a shape and dimension equal to that of aperture 15. As would be appreciated by those of skill in the art, the auxiliary locking member is operated in the manner described above for member 50, except that the user grasps the handle of handgun 11 with his left hand, and uses his left forefinger to depress the auxiliary finger rest to permit handgun 11 to be withdrawn from the holster 12.

Any desired spring means in any desired position on device 14 can be utilized in conjunction with member 50 to maintain member in the operative position shown in FIG. 3 and to return member 50 to the operative position of FIG. 3 after member 50 is laterally displaced to the position shown in FIG. 6B.

Locking member 48 is, when handgun 11 is in the holster, normally spaced slightly above member 46 of the trigger guard. Member 48 can, if desired, contact member 46 when the handgun is holstered. When, however, an attempt is made to withdraw the handgun 11 from the holster 12, member 48 contacts member 46 and prevents the withdrawal and, at the same time, finger 22 resiliently bears against muzzle 60 in the direction of arrow E in the manner shown in FIG. 1. Finger 22 resiliently bears against muzzle 60 because finger 22 is attempting to move in the directly of arrow E to return to the position shown in FIG. 4.

The embodiment of the invention depicted in FIGS. 9 and 10, includes a stove pipe 70A which is identical to stove pipe 70 except that stove pipe 70A is not as high as stove pipe 70. The locking member 50 used in the embodiment of the invention in FIG. 9 is identical to the locking member illustrated in FIG. 5 except the height of finger rest 25A is less than that of finger rest 25 and the height member 45A is less than that of 45. The holster 112 in FIGS. 9 and 10 is identical to the holster in FIG. 1 except that the portion of the side 112A of the holster covering finger rest in FIG. 9 has a greater thickness and has an opening 113 formed therein. Stove pipe 70A and finger rest 25A extend into opening 113.

By way of example, the normal thickness of the side 12A is indicated by arrow N and is typically about 0.080 inch. The thickness, indicated by arrow L, of the portion 114 of wall 112A which extends over and conceals finger rest 25A is presently preferably in the range of 0.250 to 0.300 inch. The thickness, indicated by arrows M, of the portion 114 of side 112 over finger rest 25A is about 0.020 inch. Portion 114 is pliable such that portion 114 will depress when a user manually presses on portion 114 to move finger rest 25A toward aperture 15 and to displace locking member 50 to permit the handgun 11 to be withdrawn from the holster. When the user releases finger rest 25A, spring 44 displaces finger rest 25A and pliable portion 114 away from aperture 15 to the normal operative position shown in FIG. 9. In FIG. 10, aperture 113 and portion 114 are presently about one inch wide (arrows P) by one and a half inches high (arrows Q).

Figure 4:
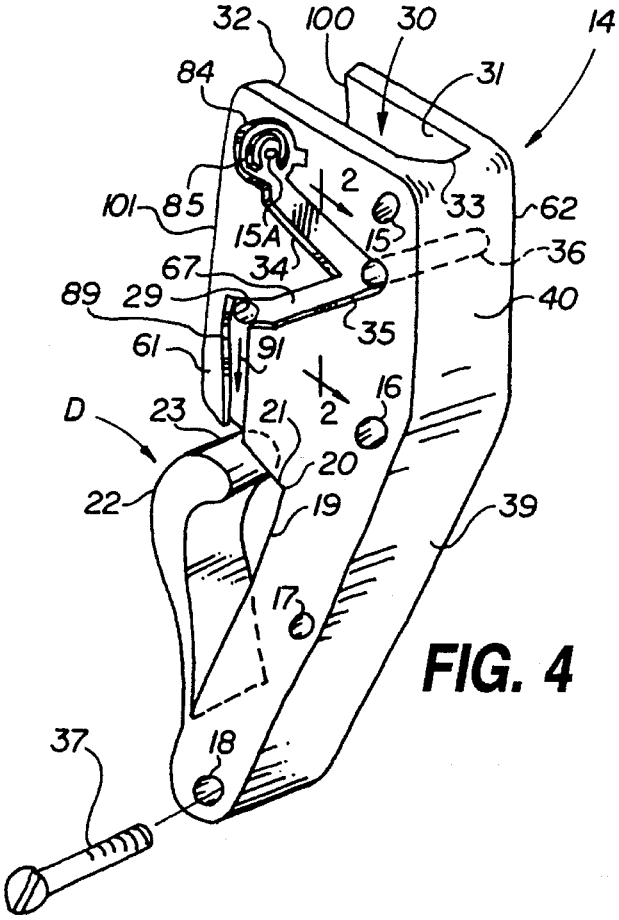
FIG. 4 is a rear perspective view illustrating the trigger guard restraining device in the holster of FIG. 1.
Figure 5:
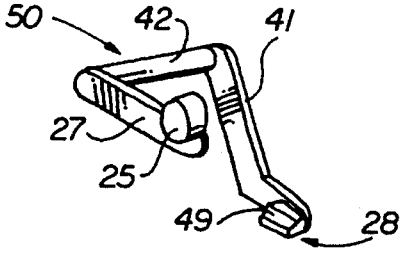
FIG. 5 is a perspective view illustrating the displaceable locking member of the trigger guard restraining device in the holster of FIG. 1.

As shown in FIG. 1, loop 96 is typically attached to side 12B of holster 12 (for a right handed individual). Belt 95 passes through loop 96 and around the waist of the user. Loops 96, belt 95, and/or holster 12 are preferably made of strong, relatively thick stiff leather or other material and loop 96 is snugly secured to belt 95 with fasteners 97, 98 or other means such that pivoting or turning holster 12 in the directions indicated by arrows R is difficult. Since pivoting holster 12 is difficult, this forces the handgun 11 to be withdrawn from holster 12 straight up in the direction of arrow S. Since the handgun 11 can only be withdrawn straight up, it is more difficult for a fugitive to pull the handgun 11 out of the holster of a police officer or other individual. In the invention illustrated in FIGS. 1 to 10 herein, the handgun 11 snugly fits in holster 12 and can not be tilted toward the front or back of the user but must instead be drawn straight up to be removed from the holster. As can be seen in FIGS. 1, 3 and 4, surfaces or edges 100 and 101 of restraining device 14 contact the underside of muzzle 60 and, along with the tight fit of the nose of muzzle 60 in the lower potion of holster 12, prevent handle 11A from being grasped and used to tilt handgun 11 in holster 12 in the direction of arrow V. Similarly, the snug fit of the top 102 of muzzle 60 against the inside of the spine of the holster and the seating of the nose of muzzle 60 between the lower end 103 of device 14 and lower end of the spine 104 prevent handle 11A from being grasped and used to pivot handgun 11 in holster 12 in the direction of arrow W in FIG. 1.

Having described my invention in such terms as to enable those skilled in the art to understand and practice it, and having described the presently preferred embodiments thereof, I claim:

1. In combination with a handgun holster having a lockable and releasable trigger guard restraining device adapted to selectively prevent withdrawal of a handgun having a trigger guard from said holster, said holster having with respect to a wearer an inner wall, and outer wall, a front, a back, a top, a bottom, and inside, an outside, and a means for suspending said holster from a belt worn by a wearer, the improvement which comprises a handgun restraining device attached to said inside of said holster at said back, said restraining device including (a) a rigid body portion and two upwardly extending vertical side wall members adjacent opposite sides respectively of said body portion forming a channel adapted to receive therein a trigger guard of a handgun;

(b) a channel formed through said rigid body portion and extending from one of said side wall members to the other of said side wall members;

(c) a locking member including (i) a first arm extending along one of said sides, (ii) a second arm extending along the other of said sides, (iii) a lock element attached to said second arm, and (iv) a rod slidably extending through said channel and interconnecting said first and second arms such that said rod and said arms can be manually laterally displaced between two operative positions, a first operative position with said lock element positioned to prevent withdrawal from said holster of a handgun having a trigger guard, and a second operative position with said lock element laterally displaced from said first operative position to permit the withdrawal from said holster of a handgun having a trigger guard.

* * * * *